US006108276A

United States Patent [19]

Chen

[11] Patent Number: 6,108,276

[45] Date of Patent: Aug. 22, 2000

[54] BELT BUCKLE WITH AN ATTACHED WATCH

[76] Inventor: Chien-Fang Chen, No. 17, Kung 6 Road, Linkou 2nd Industrial Park, Taipei Hsien, Taiwan

[21] Appl. No.: 09/176,223

[22] Filed: Oct. 21, 1998

[51] Int. Cl.[7] ..... G04B 47/00

[52] U.S. Cl. ..... 368/10; 368/282; 24/163 K

[58] Field of Search ..... 368/10, 276–282

[56] References Cited

U.S. PATENT DOCUMENTS 4,536,094 8/1985 Nagura ..... 368/10
5,102,023 4/1992 Nguyen ..... 24/163
5,106,004 4/1992 Nguyen ..... 24/163

*Primary Examiner*—Bernard Roskoski
*Attorney, Agent, or Firm*—Dougherty & Troxell

[57] ABSTRACT

A belt buckle includes a buckle body having a center opening, a bottom notch and an elongated top slot, a watch pivoted to the bottom notch of the buckle body and turned in and out of the center opening of the buckle body, a torsional spring connected between the buckle body and the watch to force the watch out of the center opening of the buckle body, and a locking lever turned about a pivot in the elongated top slot of the buckle body and forced by a spring in the elongated top slot into engagement with a locating groove at the top side of the watch to hold the watch in the center opening of the buckle body.

2 Claims, 6 Drawing Sheets

BELT BUCKLE WITH AN ATTACHED WATCH

BACKGROUND AND SUMMARY OF THE INVENTION

The present invention relates to a belt buckle for joining the ends of a belt, and more particularly to such a belt buckle which has a watch turned about an axis in and out of a center opening thereof, and releasably locked in the center opening by a spring-supported locking lever.

A wrist watch is designed to be worn on the wrist. However, a person may feel uncomfortable when wearing a wrist watch on the wrist. More particularly when wearing a wrist watch in a hot day, sweat may be gathered on the skin of the wrist beneath the casing of the wrist watch. In order to eliminate this problem, there are belt buckle manufacturers who incorporate a belt buckle with a watch. FIG. 1 shows a belt buckle having a watch Pivoted thereto. The watch is Pivoted to the buckle body of the belt buckle, and turned by hand between the closed position and the opened position. When turning the watch between the closed position and the opened position, much effort should be employed to the watch.

The present invention has been accomplished under the circumstances in view. According to one aspect of the present invention, the belt buckle comprises a buckle body having a center opening, a bottom notch and an elongated top slot, a watch Pivoted to the bottom notch of the buckle body and turned in and out of the center opening of the buckle body, a torsional spring connected between the buckle body and the watch to force the watch out of the center opening of the buckle body, and a locking lever turned about a pivot in the elongated top slot of the buckle body and forced by a spring in the elongated top slot into engagement with a locating groove at the top side of the watch to hold the watch in the center opening of the buckle body. According to another aspect of the present invention, the watch has a chamfered peripheral edge, which guides the watch into the center opening of the buckle body smoothly.

DETAILED DESCRIPTION OF THE PREFERRED EMBODIMENT

Figure 1:
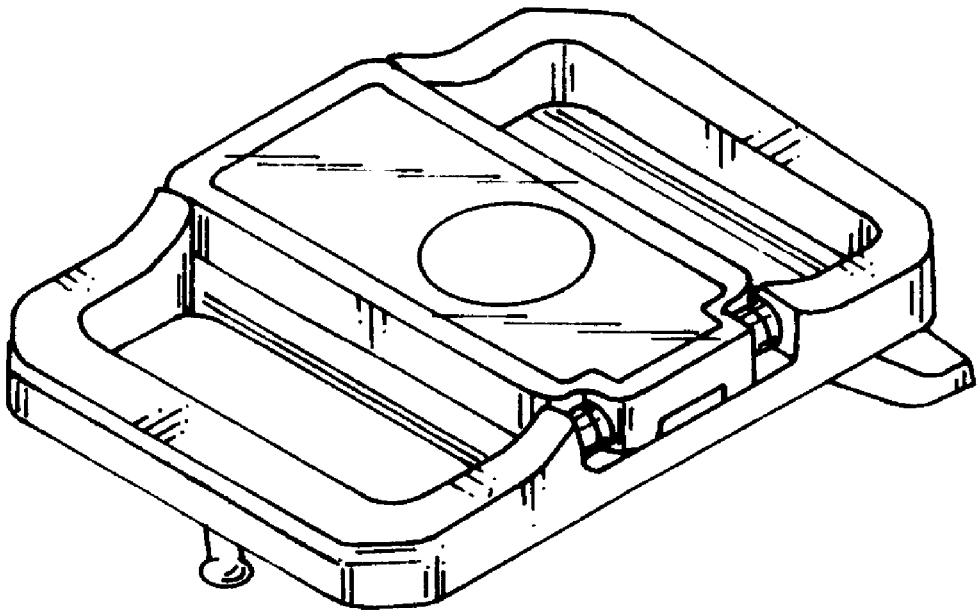
Fig.1 PRIOR ART
FIG. 1 is a perspective view of a belt buckle according to the prior art.
Figure 2:
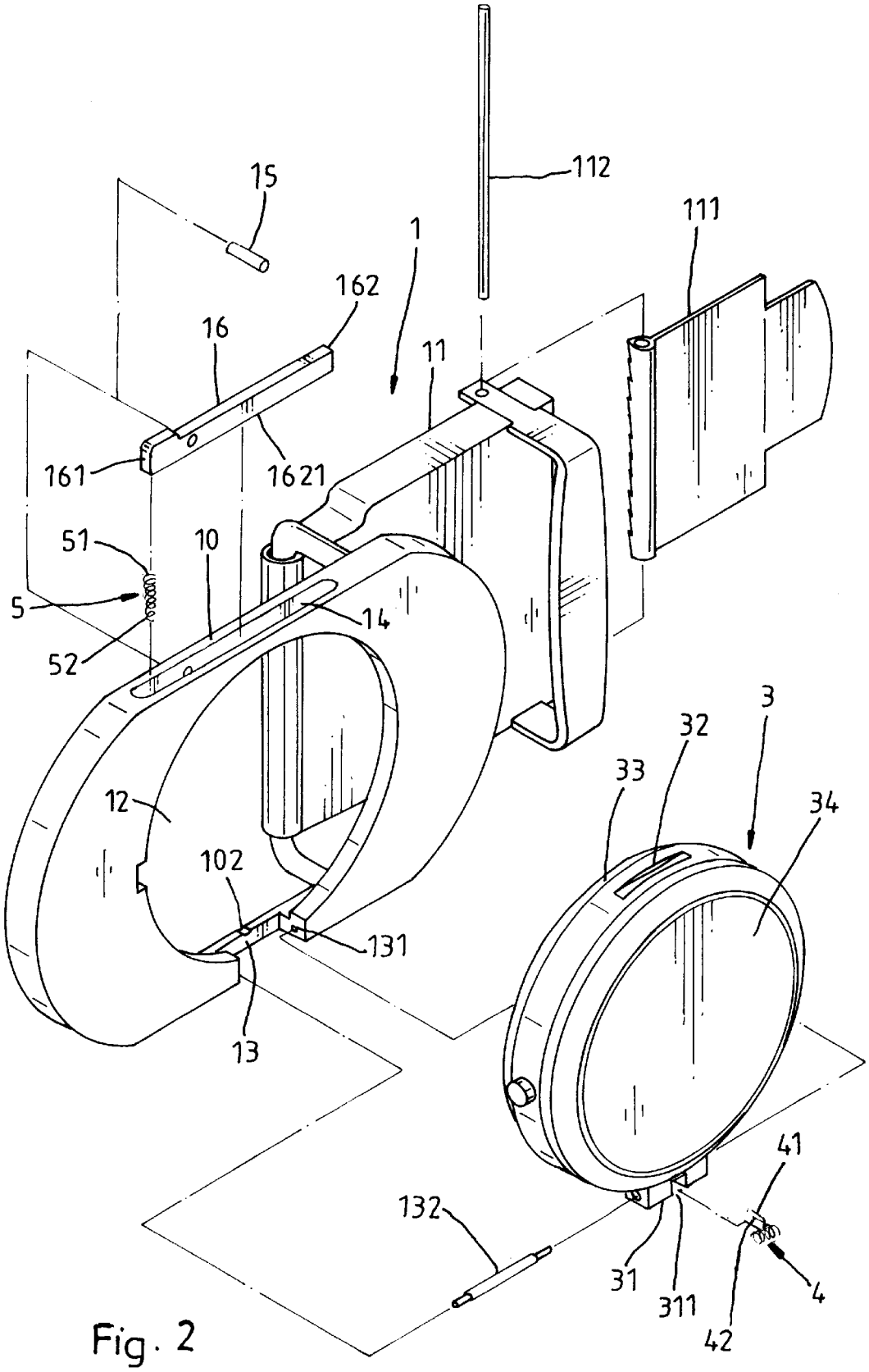
FIG. 2 is an exploded view of a belt buckle according to the present invention.
Figure 3:
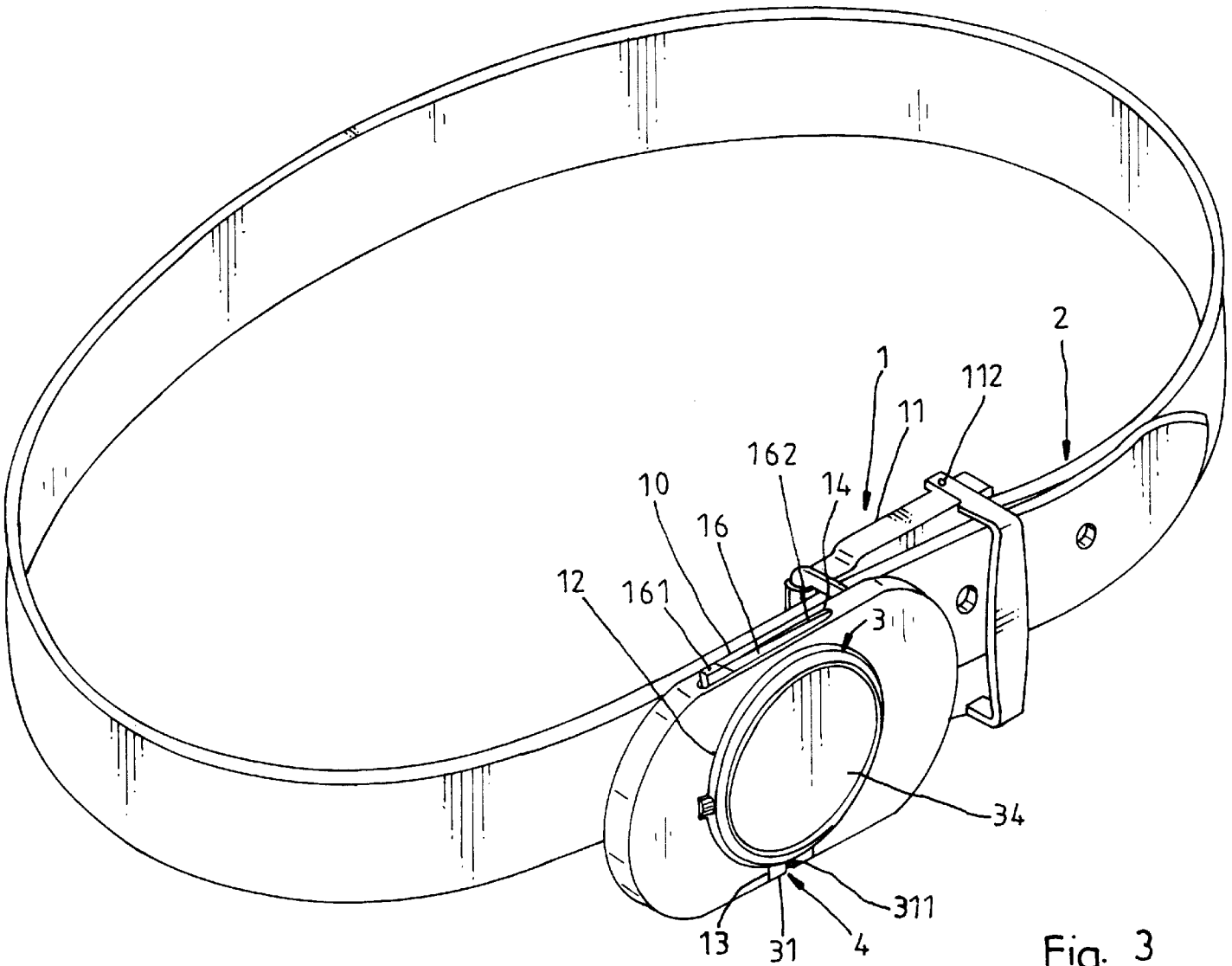
FIG. 3 is a perspective view of the present invention, showing the belt buckle fastened to a belt.
Figure 4:
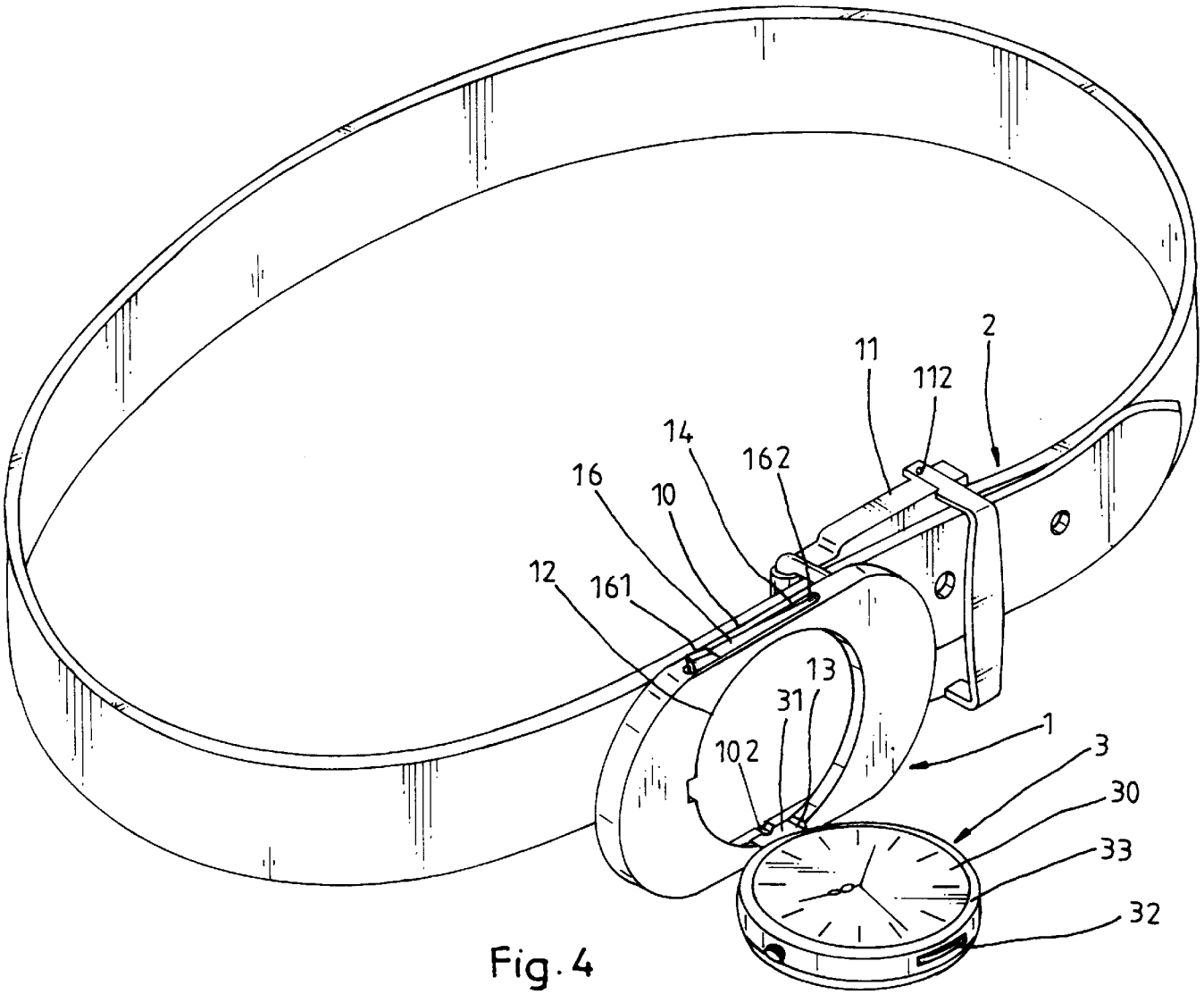
FIG. 4 is similar to FIG. 3 but showing the watch turned out of the buckle body of the belt buckle.

Referring to Figures from 2 through 4, a belt buckle 1 is shown comprising a mounting frame 11, a clamping plate 111 pivoted to the back side wall of the mounting frame 11 by a pivot pin 112 and operated to secure the mounting frame 11 to one end namely the fixed end of a belt 2, a buckle body 10 raised from the front side wall of the mounting frame 11 for guiding the other end namely the free end of the belt 2 over the front side wall of the mounting frame 11 and securing it in place, and a watch 3 pivoted to the buckle body 10.

Figure 5:
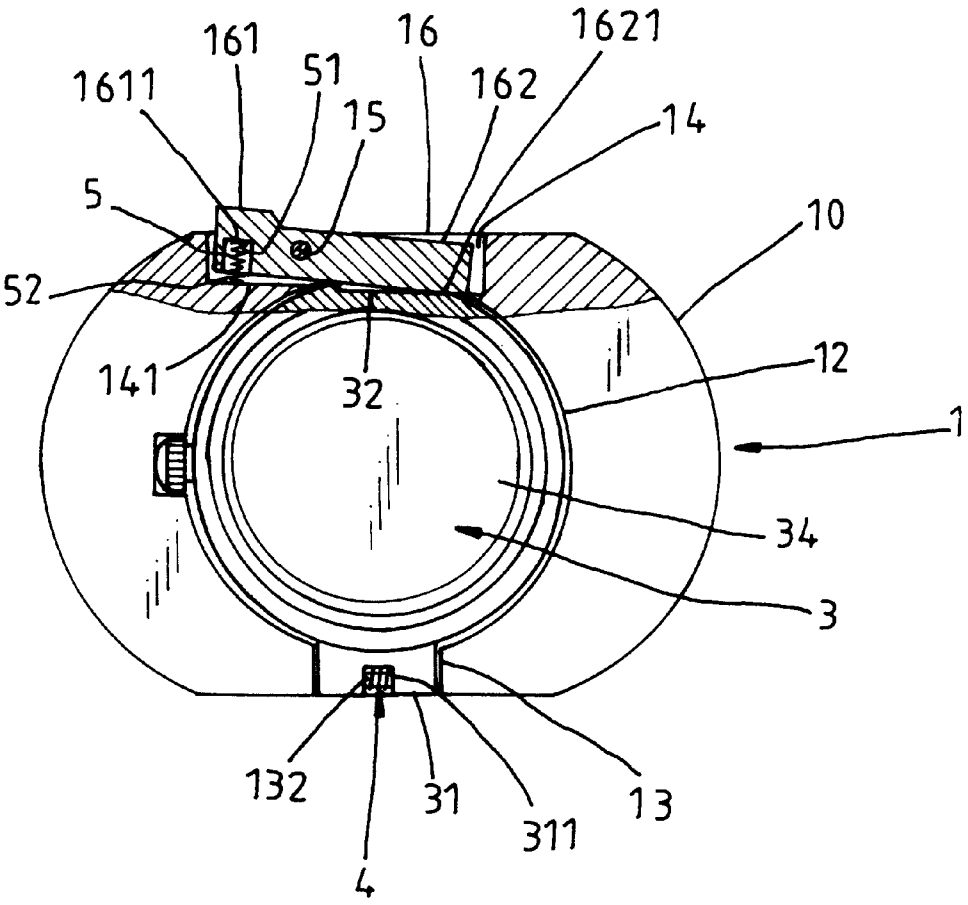
FIG. 5 is a sectional view of the belt buckle according to the present invention, showing the locking lever engaged into the locating groove of the watch, the watch retained in the opening of the buckle body.
Figure 6:
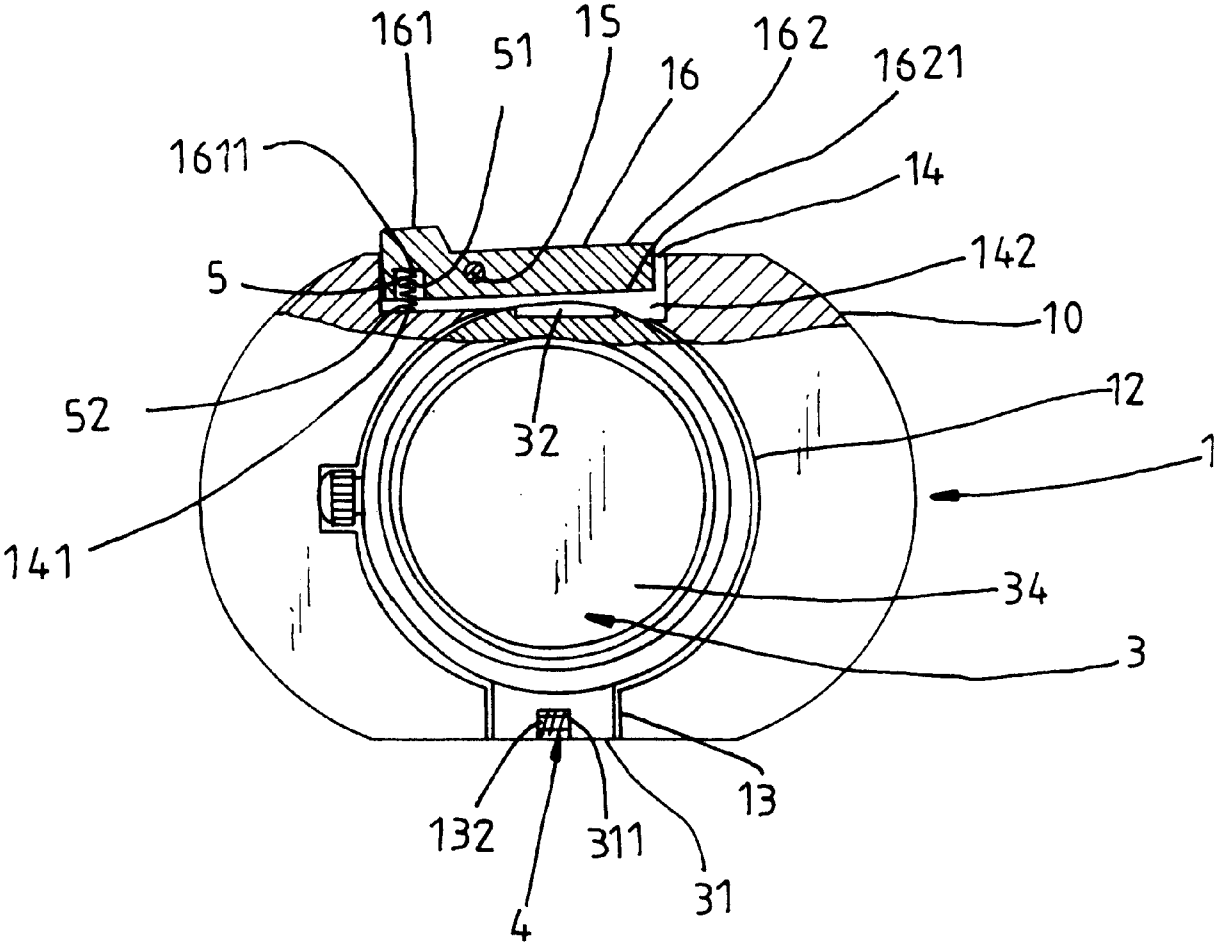
FIG. 6 is similar to FIG. 5 but showing the locking lever released from the watch.

Referring to FIGS. 5 and 6 and Figures from 2 through 4 again, the buckle body 10 comprises a center opening 12 for receiving the watch 3, a bottom notch 13 at the bottom side thereof, two pivot holes 131 horizontally aligned at two opposite sides of the bottom notch 13, a rib 102 at the back side of the bottom notch 13, and an elongated slot 14 at the top side thereof, a horizontal stop edge 141 inside the elongated slot 14 at its one end, and a passage hole 142 in communication between the center opening 12 and the other end of the elongated slot 14. A locking lever 16 is pivotably mounted in the elongated slot 14 in the buckle body 10 by a pivot 15, having a first end 161 supported on a spring 5 inside the elongated slot 14, a downward blind hole 1611 at the bottom side wall 1621 thereof near the first end 161, and a second end forced into the passage hole 142. The spring 5 is mounted in the elongated slot 14 at one end, having a bottom end 52 fastened to the horizontal stop edge 141 inside the elongated slot 14 and a top end fastened to the downward blind hole 1611 of the locking lever 16. The spring 5 imparts an upward pressure to the first end 161 of the locking lever 16, thereby causing the second end 162 of the locking lever 16 to be turned with the locking lever 16 about the pivot 15 into the passage hole 142. The watch 3 comprises two parallel lugs 31 raised from the periphery of the case frame thereof at the bottom side and separated by a gap 311, a locating groove 32 at the periphery of the case frame at the top side, an ornamental case back cover 34 covered on the back side of the case frame, a face (dial) 30 at the front side of the case frame, and a chamfered peripheral edge 33 around the face 30. The lugs 31 of the watch 3 are pivotably connected between the pivot holes 131 in the bottom notch 13 of the buckle body 10 by a pivot 132. A torsional spring 4 is mounted around the pivot 132, having a first end 41 connected to the rib 102 of the buckle body 10 and a second end 42 connected to the case frame of the watch 3. The torsional spring 4 imparts an outward pressure to the watch 3, causing the watch 3 to be turned about the pivot 132 out of the center opening 12 of the buckle body 10.

Referring to FIGS. 5 and 6 again, when the watch 3 is inserted into the center opening 12 of the buckle body 10, the locating groove 32 of the watch 3 is forced into engagement with the bottom side wall 1621 of the locking lever 16, and therefore the watch 3 is retained in the center opening 12 in the flush with the buckle body 10 (see FIG. 5). When the first end 161 of the locking lever 16 is depressed with the thumb against the spring 5, locking lever 16 is turned about the pivot 15 to lift its second end 162 from the passage hole 142 and to disengage its bottom side wall 1621 from the locating groove 32 of the watch 3, and therefore the watch 3 is forced by the spring force of the torsional spring 4 to turn about the pivot 132 outwards from the center opening 12 of the buckle body 10 from the closed position shown in FIG. 5 to the opened position shown in FIG. 6. When the watch 3 is pushed back into the center opening 12 of the buckle body 10, the locking lever 16 is automatically forced by the spring 5 into engagement with the locating groove 32 of the watch 3 to hold the watch 3 in the closed position again. Further, the design of the chamfered peripheral edge 33 enables the watch 3 to be smoothly guided from the opened position shown in FIG. 6 to be closed position shown in FIG. 5.

What is claimed is:

1. A belt buckle comprising a buckle body and a watch coupled to said buckle body, wherein said buckle body comprises a center opening, which receives said watch, a bottom notch at a bottom side thereof, two pivot holes horizontally aligned at two opposite sides of said bottom notch, a rib at a back side of said bottom notch, an elongated slot at a top side thereof in communication with said center opening, a pivot transversely mounted in said elongated slot, a locking lever turned about the pivot in said elongated slot, said locking lever having a rear end and a front end respectively spaced from the pivot in said elongated slot at different distances, and a second spring element mounted in said elongated slot and imparting an upward pressure to the first end of said locking lever; said watch comprises two parallel lugs raised from a bottom side thereof and pivotably connected between the pivot holes in the bottom notch of said buckle body by a pivot, and a locating groove at a top side thereof, which is forced into engagement with the second end of said locking lever when said watch is inserted into the center opening of said buckle body, enabling said watch to be firmly retained in the center opening of said buckle body; a torsional spring is mounted around the pivot in the bottom notch of said buckle body to force said watch out of the center opening of said buckle body, said torsional spring having one end connected to the rib of said buckle body and an opposite end connected to said watch.

2. The belt buckle of claim 1 wherein said watch has a chamfered peripheral edge for guiding said watch into the center opening of said buckle body.

* * * * *